United States Patent [19]

Hermann

[11] Patent Number: 4,569,093

[45] Date of Patent: Feb. 11, 1986

[54] SEAT STRUCTURE

[75] Inventor: Thomas J. Hermann, Riverside, Calif.

[73] Assignee: Fleetwood Enterprises, Inc., Riverside, Calif.

[21] Appl. No.: 536,692

[22] Filed: Sep. 28, 1983

[51] Int. Cl.[4] ..... A47C 17/17

[52] U.S. Cl. ..... 5/47; 5/18 R; 5/37 R

[58] Field of Search ..... 5/17, 18 R, 37 R, 41, 5/47

[56] References Cited

U.S. PATENT DOCUMENTS

| | | | |
|---|---|---|---|
| 1,437,771 | 12/1922 | Mintz | 5/18 R |
| 3,571,825 | 3/1971 | Bendell | 5/17 |
| 3,896,512 | 7/1975 | Black | 5/17 |
| 4,217,669 | 8/1980 | Fefferman | 5/47 |

FOREIGN PATENT DOCUMENTS

| | | | |
|---|---|---|---|
| 1093873 | 5/1955 | France | 5/37 |
| 1142148 | 9/1957 | France | 5/47 |

*Primary Examiner*—Kenneth J. Dorner
*Assistant Examiner*—Michael F. Trettel
*Attorney, Agent, or Firm*—Edward D. O'Brian; K. H. Boswell

[57] ABSTRACT

A seat structure capable of being manipulated between a normal seat or chair position and a bed position can be formed so that the seat bottom and the seat back are used along with a base of the seat structure as parts of a five-bar linkage system. A structure is provided on the base and on the seat bottom for controlling the movement of the seat bottom and the other parts connected to it in this linkage system as the seat bottom is moved between the seat and bed configurations. Interlocks are provided between the base and the seat bottom for preventing up or down movement of the back of the seat and the seat back when the seat structure is in the seat configuration.

2 Claims, 7 Drawing Figures

SEAT STRUCTURE

BACKGROUND OF THE INVENTION

The invention set forth in this specification pertains to new and improved seat structures which are constructed in such a manner that they are capable of being manipulated between a seat configuration in which they can be used as a seat and a bed configuration in which they are capable of being utilized as a bed or a lounge.

Seat structures which are capable of being manipulated in this manner are referred to in various different ways depending upon the manner in which they are either constructed or used. Apparently, there is no well defined set of English generic terms which can be utilized to precisely and accurately define seat structures which are intended to be used as either a chair or a bed. Occasionally, such structures are referred to as "convertible sofas". The term "daybed" is occasionally applied to such structures. If such structures are primarily intended for outdoor use, they are frequently referred to as "lounges". Various other different terms than are specifically enumerated here are used in connection with these seat structures which can be manipulated between two different configurations as noted.

Any such seat structure which is capable of being manipulated between seat and bed configurations should possess a number of different characteristics or attributes making it particularly desirable in one or more different regards. It is particularly important that any such structure be comparatively and inexpensive to construct and that it operates properly with minimal maintenance. It is equally important that any such structure be of such a character that it is capable of being manipulated with minimal difficulty between seat and bed configurations. For many applications such as, for example, in travel trailers and the like it is considered desirable to make any such seat structure as light as possible so as to decrease the weight of any such structure.

BRIEF SUMMARY OF THE INVENTION

Although many different convertible or folding seat structures have been developed and used in the past, it is considered that none of such prior structures have been of such a character as to adequately combine in a single unit the desirable characteristics of ease and convenience of manufacture, low cost, comparatively light weight, easy operation and manipulation as well as, of course, satisfactory performance as either a seat or as a bed. A broad objective of the present invention is to provide seat structures which combine all of these desirable attributes into a single structure. The invention is especially intended to provide seat structure as noted which, because of their light weight and constructional details, are of such a character as to be particularly adapted for use in travel trailers, motor homes and the like where weight is more important than it is in connection with seat structures for use in an apartment, a house or the like.

In accordance with this invention, the objectives of the invention are achieved by providing a seat structure as described utilizing front and rear linkage means extending between a base and a seat and a base and a seat back, respectively, together with pivot means connecting the seat back with the seat bottom so as to create a five-bar linkage system capable of being manipulated in moving the seat back and the seat bottom between seat and bed configurations. Because of the inherent flexibility of such a five-bar linkage system, cooperating motion control means are provided on the base and the seat bottom for controlling the motion of the linkage system so that the seat back and seat bottom can only be moved between the seat and bed configurations. The motion control means are also utilized in connection with cooperating interlocking means on the base and the seat bottom so as to prevent up or down movement of the seat back and the adjacent portion of the seat bottom when the seat structure is in the seat configuration. No such interlocking means are needed when the seat structure is in the bed configuration because of the construction of the linkage system employed.

BRIEF DESCRIPTION OF THE DRAWINGS

This invention can be most easily explained to a further extent by referring to the accompanying drawings in which.

The seat structure shown in the accompanying drawings is constructed so as to utilize the operative concepts or principles of the present invention defined in the appended claims. These concepts and/or principles can be utilized in somewhat differently appearing, somewhat differently constructed seat structures through the use or exercise of routine mechanical engineering skill. As a consequence of this, this invention is not to be considered as being limited by the precise structure or to the precise structure shown in the accompanying drawings or described herein.

DETAILED DESCRIPTION

Figure 3:
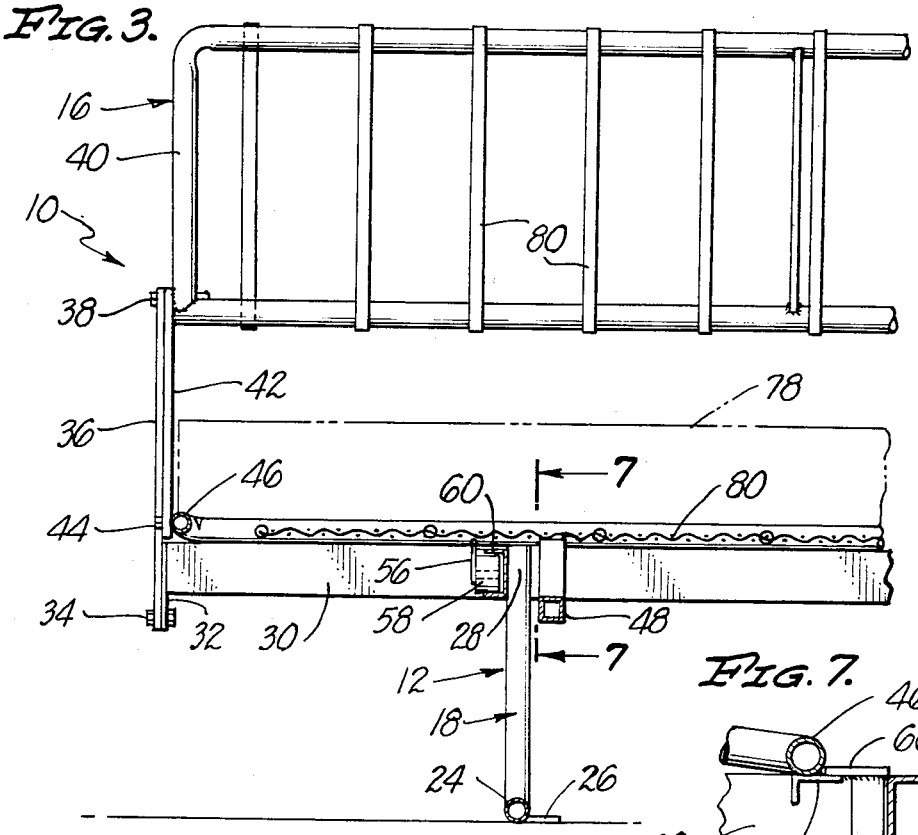
FIG. 3 is a partial cross-sectional view taken at line 3—3 of FIG. 1.
Figure 4:
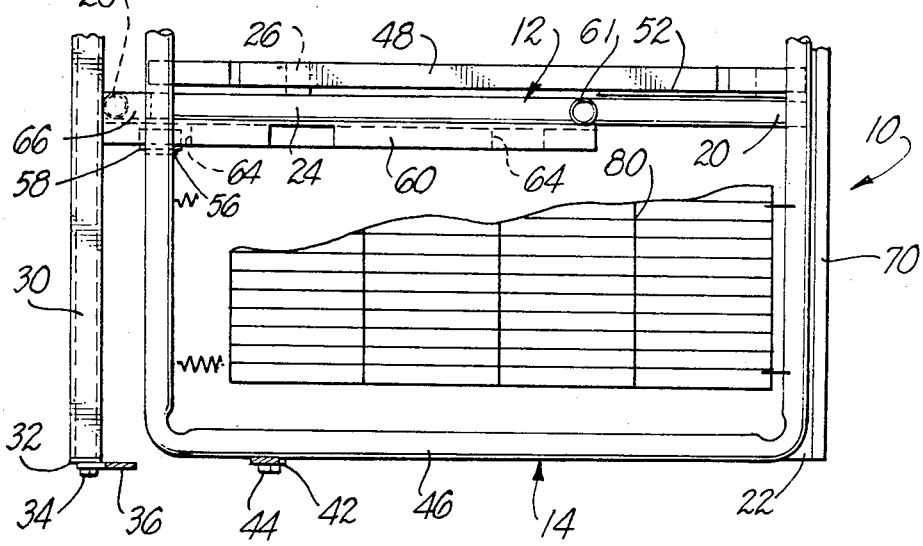
FIG. 4 is a partial cross-sectional view taken at line 4—4 of FIG. 1.

In the drawings there is shown a complete seat structure 10 of the present invention which includes a base 12 which is utilized to support a seat bottom 14 and a seat back 16. The two ends (not separately numbered) of this seat structure 10 are identical. Because of this, only the left-hand portion (not numbered) of the seat structure 10 is illustrated in FIGS. 3 and 4. This base 12 includes two floor supports 18 which serve more or less as conventional legs. These supports 18 include front ends 20 which are secured together through a trim board 22, floor runs 24 which are adapted to be secured to a floor through conventional brackets 26 when this is reasonably desirable or required and upper rear ends 28. These ends 28 are secured to a rear cross bar 30.

The ends 32 and the cross bar 30 are connected by pivots 34 to two separate rear links 36. These links 36 are connected by other pivots 38 to a frame 40 forming a part of the seat back 16. This same frame 40 has lower ends 42 which are connected by further pivots 44 to another frame 46 forming a part of the seat bottom 14. This seat bottom 14 also includes two bowed braces 48 attached to and forming a part of the frame 46. These braces 48 are secured by further pivots 50 to front links 52 which in turn are attached by other pivots 54 to small brackets 56 mounted upon the front ends 20 of the supports 18.

From a consideration of the manner in which the base 12, the seat bottom 14 and the seat back 16 are used in conjunction with the links 36 and 52 it will be realized that the seat structure 10 when viewed from an end (not numbered) constitutes a composite type five-member or five-bar linkage. The various pivots as indicated in the preceding used in this linkage give it an extreme degree of flexibility. This flexibility permits the seat structure 10 to be manipulated between the two positions shown in FIGS. 1 and 2 but, creates or defines an unstable structure.

Figures 1, 2, 5, 6:
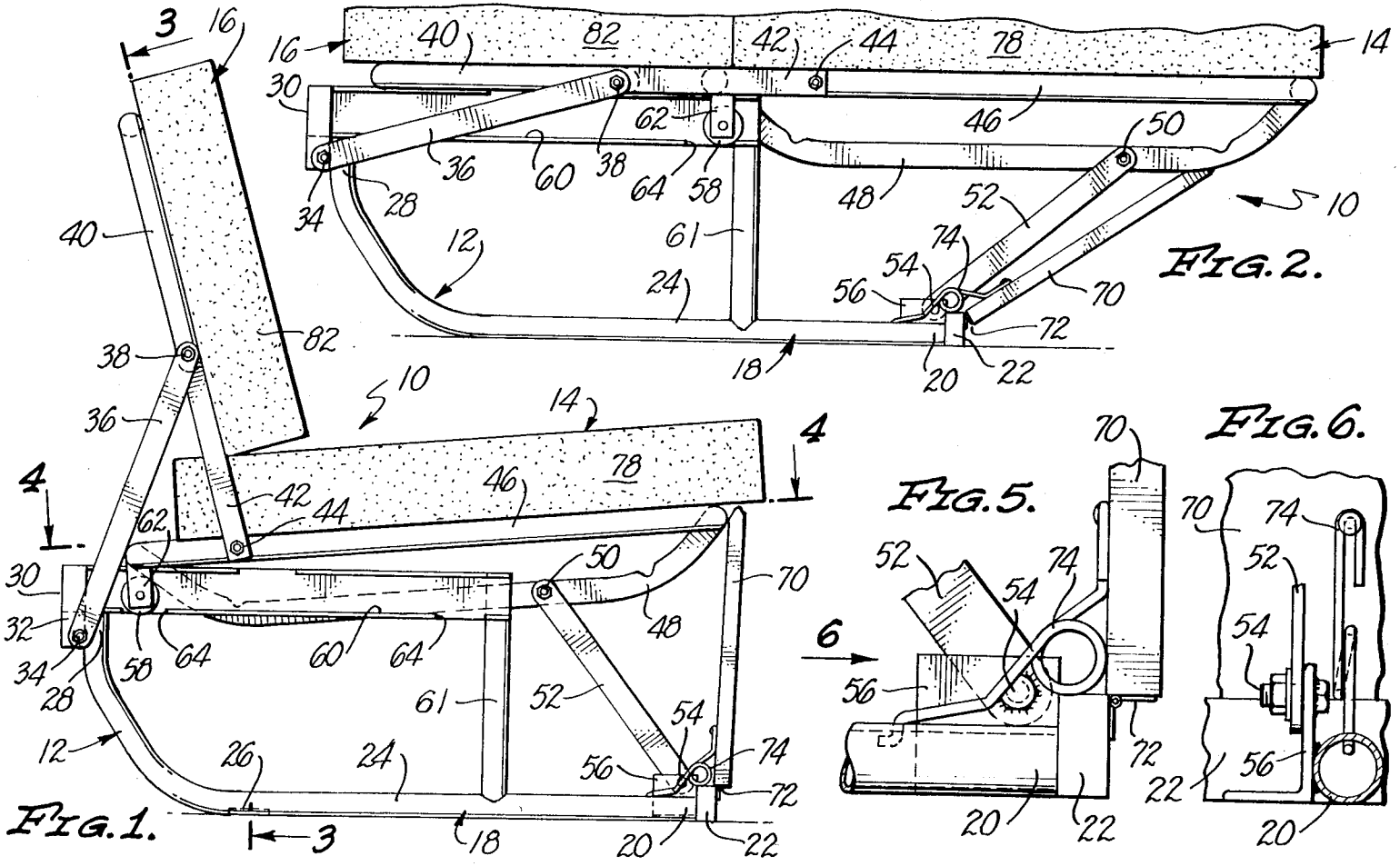
FIG. 1 is an end elevational view of a presently preferred embodiment or form of a seat structure in accordance with this invention in a seat configuration.
FIG. 2 is a view similar to FIG. 1 of the seat structure in a bed configuration.
FIG. 5 is an enlarged fragmentary view of a portion of the seat structure, this view corresponding to a part of FIG. 1.
FIG. 6 is a view taken in the direction of the arrow 6 in FIG. 5 showing in elevation that part of the seat structure illustrated in FIG. 5.

Because of this, the complete seat structure 10 utilizes what may be referred to as cooperating motion control means 58 and 60 which serve to limit movement of various parts as previously described so that the seat bottom and the seat back 14 and 16, respectively, adjacent to each of the supports 18 can only be manipulated between the two positions indicated in FIGS. 1 and 2. Each of the means 58 comprises a small roller (not separately numbered) carried by a downwardly extending bracket 62 which is attached to the frame 46 generally towards the rear of it. Since the rollers are the means previously identified by the numeral 58, they are designated herein by this same number 58.

The other means 60 comprise channels (not separately numbered) having a U-shaped cross-sectional configuration. For convenience, these channels will be referred to using the number 60 since they constitute the means previously identified by this number. These channels 60 are supported by uprights 61 from the supports 18 and serve as rails for the rollers 58 enabling the rear (not separately numbered) of the seat bottom 14 to be guided as the seat structure is manipulated between the two configurations shown in FIGS. 1 and 2. This guidance provides a desired degree of stability for the linkage system previously described.

To prevent inadvertent movement of the rollers 58 within the channels 60 when the various parts of the seat structure 10 are in positions as shown in FIGS. 1 and 2, it is possible to provide small openings 64 in the channels 60 adjacent to the positions of the rollers 58 in the extreme positions of the seat bottom 14. The channels 60, the brackets 62 and these rollers 58 are preferably dimensioned so that the frame 46 will "bottom out" on the channels 60 in these extreme seat and bed configurations. This will not be adequate to satisfactorily hold the seat bottom 14 or the seat back 16 against inadvertent movement as, for example, when the seat structure 10 is being used.

Figure 7:
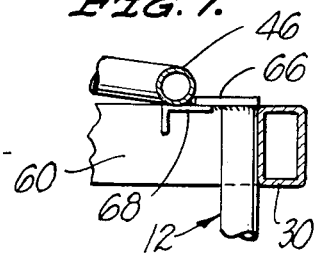
FIG. 7 is an enlarged detailed, cross-sectional view taken at line 7—7 of FIG. 3.

As a consequence of this, it is considered necessary to utilize with the seat structure 10 what may be regarded as cooperating interlocking means 66 and 68 on the channel 60 and on the frame 46 which will engage one another so as to prevent either upward or downward movement as the seat structure 10 is used as a seat in a configuration as indicated in FIG. 1. These means 66 and 68 comprise small interfitting brackets (not separately numbered) which are located as shown in FIG. 7.

Preferably, the seat structure 10 includes a front cover board 70 connected to the board 22 through the use of hinges 72. This board 70 is normally biased towards a vertical position through the use of a small wire spring 74 extending between the supports 18 and this board 70. This board 70 is dimensioned so as to extend generally in front of the frame 46 from beneath a cushion 78 forming a part of the seat bottom 14. This board 70 is desirable in that it provides access beneath the seat bottom 14 for storage and other purposes.

In manipulating the seat structure 10 from a seat configuration as shown in FIG. 1 to a bed configuration shown in FIG. 2, this board 70 may be manually engaged and pivoted out of a vertical position. Then the frame 46 may be engaged and pulled forward. As this occurs, the rollers 58 will be guided in the channels 60 and the seat back 16 will be pivoted to a substantially horizontal position. The amount that the seat bottom 14 can be pulled in this manner is limited by the dimensions of the various components as described. When it is in a forward position, the board 70 will be biased against the braces 48 and the front links 52 will slope outwardly away from the supports 18. In this bed configuration as indicated in FIG. 2, the rollers 58 will be located over the openings 64 in such a manner as to preclude what may be referred to as "easy" movement of the seat bottom 14 and seat back 16.

When it is desired to return the seat structure 10 to a normal seating configuration as shown in FIG. 1, the frame 46 may be pushed backwardly as the frame 40 of the seat back 16 is engaged so as to be pivoted in generally a clockwise manner. As this occurs, there will be some sliding contact between the channels 60 and the frame 46 and then the rollers 58 will, in effect, support the frame 46 until such time as the seat back is in a position as shown in FIG. 2 and the means 66 and 68 are brought into engagement with one another. At this point, the front links 52 will extend at a diagonal to the supports 18 generally towards the rear (not separately numbered) of the seat structure 10. In so doing, they serve to support the seat bottom 14 so that it is not completely horizontal but, instead, slopes rearwardly in the manner of a normal chair bottom to a very limited extent.

The details of the seat bottom 14 and the seat back 16 may be varied to a considerable extent in accordance with conventional practice in the furniture industry. Since such details are not pertinent to the operation of the present invention, they have not been described in detail in the preceding.

Generally appropriate supports 80 are used in connection with the seat bottom 14 and the seat back 16 for the purpose of flexing slightly as weight is applied to the cushions 78 and 82 forming a part of the seat bottom 14 and the seat back 16, respectively. These cushions may be conveniently attached in place in any conventional known manner. The particular cushions 78 and 82 should be sufficiently flexible and resilient to accommodate a minor amount of interference between them as the seat structure 10 is manipulated.

I claim:

1. A seat structure which can be manipulated between a seat configuration and a bed configuration, said seat structure including a base, a seat bottom and a seat back, both said seat bottom and said seat back being mounted on said base so as to be capable of being moved between said seat and said bed configuration, said seat bottom and said seat back being horizontally disposed in edge to edge relation in said bed configuration, said seat back extending generally vertically from said seat bottom when in said seat position in which the improvement comprises:

front linkage means extending between and pivotally connected to both said base and said seat bottom, rear linkage means extending between and pivotally connected to both said base and said seat back, pivot means connecting said seat back and said seat bottom, said base, said front linkage means, said seat bottom and said seat back and said rear linkage means constituting a five-bar linkage system which is manipulatable so as to move said seat back and said seat bottom between said seat and bed configurations, cooperating motion control means on said base and said seat bottom for controlling the motion of said seat bottom so that it can only be manipulated between said seat and bed configurations and thereby controlling the movements of said front and rear linkage means and said seat back, said motion control means serving to hold said seat bottom so that it slopes generally downwardly towards said seat back when said seat is in said seat configuration, and cooperating interlock means on said base and on said seat bottom for preventing up and down movement of said seat back and the adjacent portion of said seat bottom when said seat structure is in said seat configuration, said cooperating motion control means are formed so that each of said means includes a channel located on said base and a roller located on said seat bottom, openings are provided in said channels so that said rollers will pass into said openings and will not be supported in said channels when said seat structure is in said seat and said bed configurations and in which said seat bottom rests directly on said channels and is supported only by said channels in such configurations.

2. A seat structure as claimed in claim 1 wherein:

said front and rear linkages, said seat bottom, said seat back and said base being of such dimensions as being connected together so that said seat back does not extend rearwardly of the rear of said base when said seat structure is in said seat and bed configurations and as said seat back and said seat bottom are manipulated between said seat and bed configurations.

* * * * *